United States Patent [19]

Streich et al.

[11] 4,322,181

[45] Mar. 30, 1982

[54] CONDUCTOR PIPE PLUG AND METHOD OF INSTALLING CONDUCTOR PIPE

[75] Inventors: Steven G. Streich; R. Benton Nickles, Jr., both of Duncan, Okla.

[73] Assignee: Halliburton Company, Duncan, Okla.

[21] Appl. No.: 144,091

[22] Filed: Apr. 28, 1980

[51] Int. Cl.[3] ..... E02D 5/54

[52] U.S. Cl. ..... 405/224; 405/253

[58] Field of Search ..... 405/227, 228, 224, 225, 405/253; 175/19, 22, 23

[56] References Cited

U.S. PATENT DOCUMENTS

| | | | |
|---|---|---|---|
| 1,101,364 | 6/1914 | Wallett | 405/253 X |
| 1,778,925 | 10/1930 | Thornley . | |
| 1,994,846 | 3/1935 | Baker . | |
| 2,117,537 | 5/1938 | Baker . | |
| 2,421,993 | 6/1947 | Cobi . | |
| 3,141,305 | 7/1964 | Schenk . | |
| 3,467,271 | 9/1969 | Kaiser et al. . | |
| 3,474,630 | 10/1969 | Pogonowski . | |
| 3,543,524 | 12/1970 | Clements . | |
| 3,924,413 | 12/1975 | Marsh, Jr. . | |
| 4,212,563 | 7/1980 | Weidler et al. | 405/227 |
| 4,240,767 | 12/1980 | Gracia | 405/227 |

*Primary Examiner*—Carl D. Friedman

*Attorney, Agent, or Firm*—Joseph A. Walkowski; John H. Tregoning

[57] ABSTRACT

A plug for sealing the end of conductor pipe of offshore platforms comprising a cylindrical housing filled with a core of cementitious material, the housing being fixed to the end of the conductor pipe. A method of installing the conductor pipe is also disclosed.

5 Claims, 7 Drawing Figures

CONDUCTOR PIPE PLUG AND METHOD OF INSTALLING CONDUCTOR PIPE

BACKGROUND OF THE INVENTION

This invention relates to a non-retrievable plug for sealing the bore of hollow cylindrical or tubular members, particularly conductor pipe employed with offshore platforms, and to a method for sinking such conductor pipes.

A typical offshore platform has a plurality of conductor pipes running from the top of the platform to the bottom thereof. After the platform is set in place, the conductor pipes are driven into the sea bottom and wells drilled from the platform through the pipes. To give added buoyancy to the platform as it is moved and set in place, the end of each conductor pipe is sealed with a plug to prevent the ingress of water. As an offshore platform may be 1,000 or more feet from top to bottom, the plug in the conductor pipe must be capable of withstanding large hydrostatic pressures when the platform is installed on the sea bottom.

Several different prior art approaches have been taken in plug design and construction. One typical prior art plug comprises a steel cup retained within a cylindrical housing welded to the end of a conductor pipe of the same diameter. The steel cup is retained within the housing by means of a molded elastomeric member which has a portion of the cup retrieving cable spirally wrapped within. To retrieve the cup from the conductor pipe an upward force is applied to the free end of the cable at the top of the pipe, whereupon the cable molded in the elastomeric member progressively rips the elastomeric member apart, freeing the steel cup to move upwardly in the conductor pipe. Such a plug is easy to use, but it is difficult to control the molding process and the accurate placement of the cable within the elastomeric member to ensure proper performance. Furthermore, this type of plug leaves a residue of elastomeric material within the conductor pipe, which may, if large enough, interfere with subsequent drilling operations through the pipe. Another approach to conductor pipe plugs is disclosed in U.S. Pat. No. 4,178,967, issued on Dec. 18, 1979 to Steven G. Streich and assigned to the assignee of the present application. The patent discloses a retrievable, reusable conductor pipe plug which is mechanically locked into place in a housing welded to the bottom of the conductor pipe until it is retracted and withdrawn from the conductor pipe by application of upward force on a cable. While this type of plug is reusable, manufacturing costs are relatively high and failure or jamming of the retraction mechanism is always possible, which events would require the destruction of the plug and removal of the resulting debris, a laborious and difficult procedure. In addition, unless the plug incorporates a device to equalize pressure on both sides of the plug, it is necessary to fill the conductor pipe with fluid prior to removal to prevent rapid and possibly damaging upward movement of the plug due to the large hydrostatic forces acting upon the plug bottom. Finally, certain parts of the plug must be replaced prior to every re-use.

In using the prior art plugs, the step of removing the plug comprises an additional operation to the procedure of driving the conductor pipe and sinking the well therethrough, requiring additional time on the job as well as care in removing the plug.

SUMMARY OF THE INVENTION

In contrast to the prior art, the present invention is a destructible, non-retrievable, single-use plug comprising a cylindrical housing filled with a core of frangible material, the housing being fixed to the end of a conductor pipe of like diameter. The physical configuration of the frangible material, as well as its composition, may be altered depending on the hydrostatic pressure to be encountered, and whether the operator wishes to break up the plug core at the same time the conductor pipe is being driven, or wishes to drill it out after it is embedded in the sea bottom by the drill used to sink the well associated with that conductor pipe. Thus, there is disclosed an inexpensive, easily removable plug which does not leave damaging debris in the conductor pipe after use.

The foregoing advantages and the preferred embodiments of the present invention will be better understood from the following specification taken in conjunction with the accompanying drawings.

DESCRIPTION OF THE PREFERRED EMBODIMENTS

Figure 1:
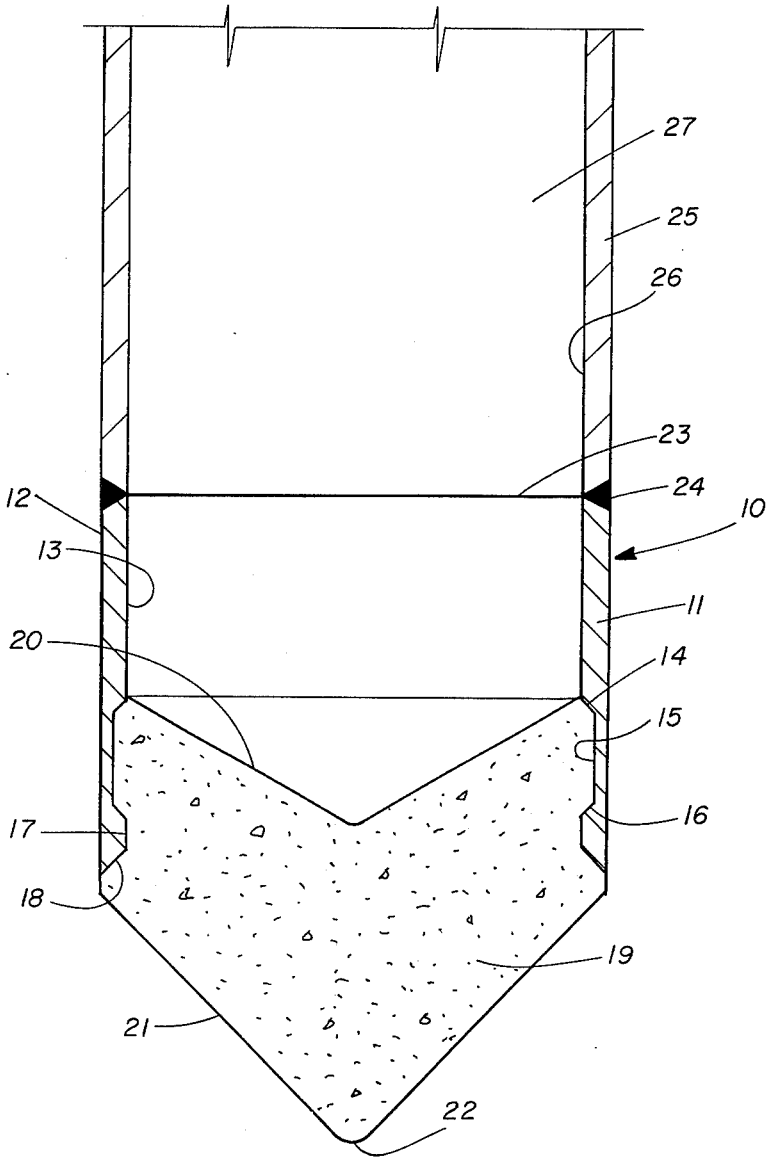
FIG. 1 is a cross-sectional view of a first preferred embodiment of the present invention.

Referring to FIG. 1, a first preferred embodiment of the present invention is shown.

The plug 10 comprises a cylindrical housing 11 having a substantially uniform outer diameter 12, and a substantially uniform upper inner surface 13. Below upper inner surface 13 is annular surface 15, defined by chamfered surfaces 14 and 16, thereby forming a channel. Below the aforesaid channel is disposed lower inner surface 17, of substantially the same diameter as surface 13. The lowest extremity of cylindrical housing 11 is outwardly beveled annular surface 18. Within cylindrical housing 11 is core 19 cast or poured of a frangible, preferably cementitious material, having conical upper surface 20 and conical lower surface 21 extending to pointed tip 22. Core 19 extends into the channel defined by annular surface 15 and chamfered surfaces 14 and 16, ensuring its attachment to cylindrical housing 11. The upper edge 23 of cylindrical housing 11 is bonded, as by welding, shown at 24, to the lower edge of conductor pipe 25. Inner surface 26 of conductor pipe 25 is of substantially the same diameter as that of upper inner surface 13 of cylindrical housing 11. Bore 27 of conductor pipe 25 extends from the top of the pipe to plug 10.

Figure 2:
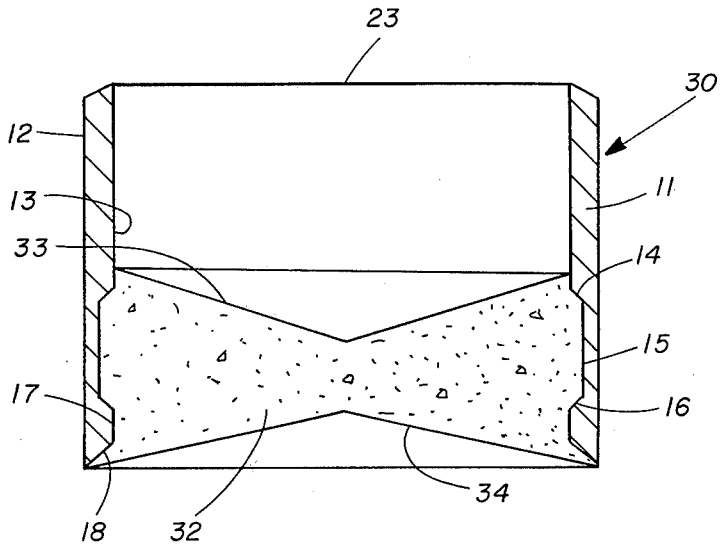
FIG. 2 is a cross-sectional view of a second preferred embodiment of the present invention.

A second preferred embodiment is depicted in FIG. 2. Plug 30, like plug 10, comprises cylindrical housing 11, having the same features as previously noted. Cast or poured within housing 11 is a core 32 of frangible, preferably cementitious material, having upper conical surface 33 and lower inverted conical surface 34. Core 32, as core 19 in plug 10, extends into the channel defined by surfaces 14, 15 and 16 of housing 11. Plug 30, as plug 10, is fixed to the bottom of a conductor pipe (not shown) by welding.

Figure 3:
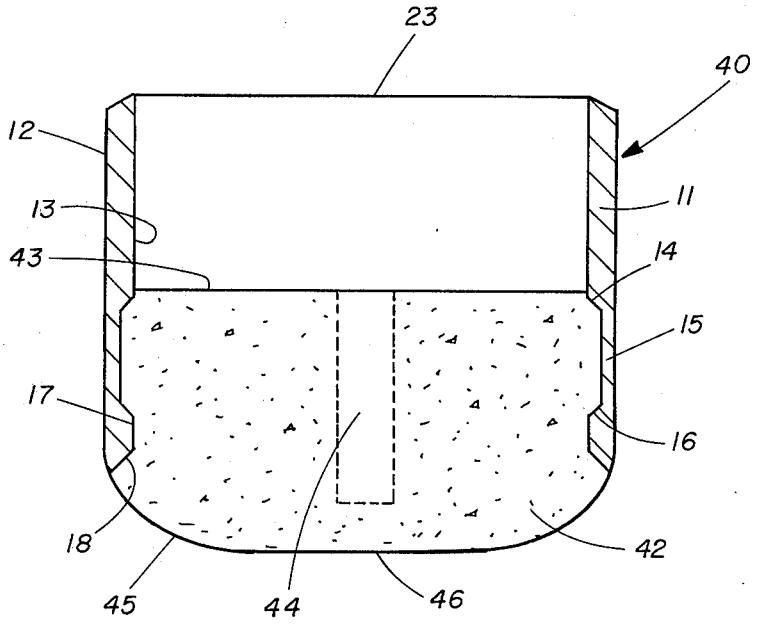
FIG. 3 is a cross-sectional view of a third preferred embodiment of the present invention.

A third preferred embodiment is depicted in FIG. 3. Plug 40 again utilizes cylindrical housing 11, having cast or poured within housing 11 frangible core 42. Core 42 has a flat upper surface 43, which is penetrated by axial bore 44. The lower surface of core 42 curves at 45 from the lowest outer edge of housing 11 to flat lower surface 46. As in plugs 10 and 30, core 42 is held within housing 11 by its engagement with the annular channel on the inside of the housing.

A cementitious material which may be used in forming the plug cores disclosed above and hereafter is a concrete based upon Maryneal Incor® cement, available as Pozmix® A cement (Lone Star Special Incor®) from Halliburton Services, Duncan, Oklahoma. However, there are various suitable high compressive and shear strength concretes which have been developed in the petroleum industry as evident to one of ordinary skill in the art.

The use of a particular plug core configuration is dependent on the results the operator sinking the conductor pipe wishes to obtain. Plug 10 of FIG. 1 provides a pointed end which facilitates driving of the conductor pipe, with breakup of the cementitious material later effected by drilling from the inside of the conductor pipe when the well associated with the conductor pipe is sunk. Upper conical surface 20 of core 19 provides a guiding effect to keep the drill bit centered as it encounters the mass. Alternatively, if the operator wishes to effect breakup of the plug core when driving the conductor pipe, plug 30 of FIG. 2 may be employed. Inverted conical surface 34 at the bottom of core 32 directs the driving forces to the center of the mass, where upper conical surface 33 is also oriented to provide a relatively thin, weak point to effect a fracture. Plug 40 of FIG. 3 provides a flat core bottom 46 which may fracture upon the driving of the conductor pipe to which it is attached, depending on the composition of the sea bottom and driving force exerted, as well as axial bore 44 which will facilitate fracture both from driving forces or, if they are not sufficient, from a drill bit encountering upper flat surface 43.

In the preferred embodiments of FIGS. 1, 2 and 3, the core would have a design thickness capable of withstanding 1,000 PSI hydrostatic pressure; this parameter is, of course a matter of choice depending upon the particular application and depth to which the plug is subjected.

DESCRIPTION OF THE ALTERNATIVE EMBODIMENTS

Alternative embodiments of the invention are depicted in FIGS. 4, 5, 6 and 7. As in the preferred embodiments, all of the alternative embodiments employ cylindrical housing 11.

Figure 4:
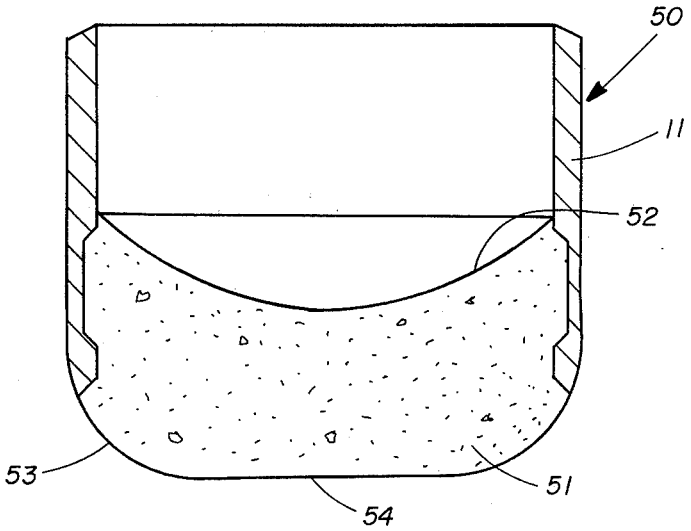
FIGS. 4, 5, 6 and 7 are cross-sectional views of alternative embodiments of the present invention.

Plug 50 shown in FIG. 4 comprises a cementitious core 51 poured or cast with concave upper surface 52, and curved lower edge 53 leading to flat lower surface 54. Concave upper surface 52 is designed to facilitate drilling out of the plug core by orienting the drill bit toward the center of the mass.

Figure 5:
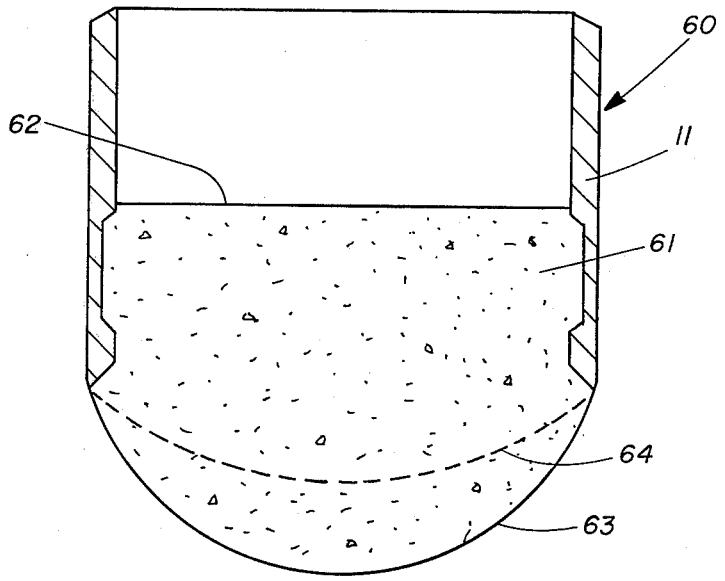

The embodiment of FIG. 5, plug 60, shows core 61 with a flat upper surface 62 and two alternative lower curved surfaces 63 and 64, both of which give a bulbous shape to the end of the plug to facilitate driving into the sea bottom.

Figure 6:
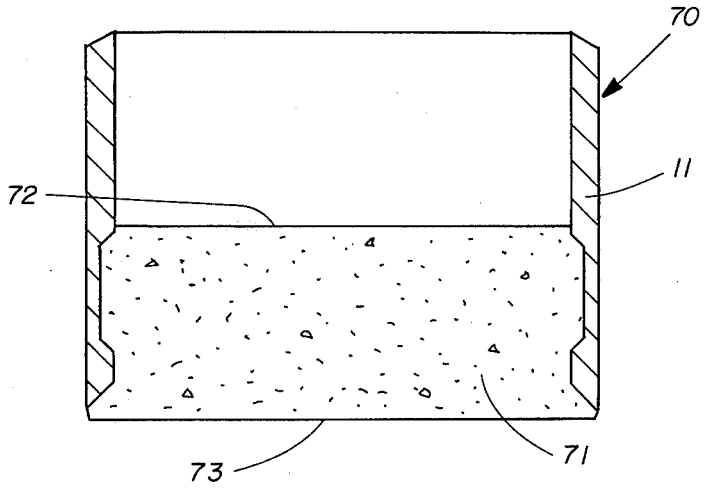

FIG. 6, showing plug 70, depicts core 71 having flat upper and lower surfaces 72 and 73, respectively. This shape is, of course, the easiest to form of those disclosed, but possesses no special features to assist conductor pipe driving or subsequent breakings of the plug core.

Figure 7:
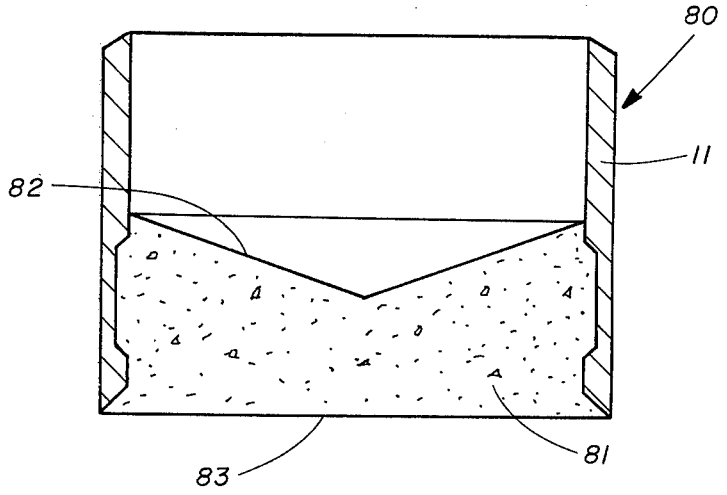

FIG. 7, showing plug 80, has a relatively simple configuration similar to plug 70, but core 81 has a conical upper surface 82 to provide a weaker center area for possible breakup during driving and to facilitate drilling out, if necesary. Lower surface 83 is substantially flat.

While the embodiments disclosed herein deal with the use of cement as a plug core, the scope of the invention is, of course, not so limited. Any frangible material may be employed, such as glass or hard plastic. The important consideration is that the plug core be able to withstand relatively high static pressure yet be drillable and/or breakable under impact force so as not to interfere with the drill bit, a problem noted with respect to one of the prior art plugs described above. Furthermore, if desired to assure core integrity until drilling out occurs, reinforcing elements of drillable material may be incorporated in the core. The annular channel shown to hold the core in place in the housing of the plug may be replaced with several smaller annular channels or individual depressions in the housing wall, if desired. Furthermore, small protrusions or a shallow annular ring of drillable material fixed to the inner wall of the housing may be employed to hold the core in place.

It is apparent from the foregoing description that the present invention has significant advantages of:

Extremely simple construction;
Low cost;
Ease of quality control;
Positive assurance of removal from the end of the conductor pipe;
Lack of residue or obstructions in the conductor pipe after removal, as the fractured core material is conducted back to the platform with drilling fluid; and
Ease of operation.

Although the invention has been described with reference to sealing off the end of conductor pipe driven from offshore platforms, it is understood that the invention may be employed whenever it is desired to provide a seal across the bore of a cylindrical member, and that conductor pipes or other cylindrical members using the plug of the present invention may be embedded in the sea bottom by methods other than driving; for example jetting may be employed.

Having described the invention, we claim:

1. A method of installing a conductor pipe employed in sinking a well in a sea bottom, comprising:
providing a conductor pipe;
affixing a plug to the lower end of said conductor pipe, said plug having a fracturable core therein;
driving said conductor pipe into said sea bottom; and
fracturing said core of said plug substantially simultaneously with said driving.

2. A method of installing a tubular member in a sea bottom, comprising:
providing a tubular member;
affixing a plug to the lower end thereof, said plug having a core therein;
penetrating said sea bottom with the plugged end of said tubular member; and
fracturing said core of said plug substantially simultaneously with said penetrating.

3. A method of installing a conductor pipe employed in sinking a well in a sea bottom, comprising:
providing a conductor pipe;

affixing a plug to the lower end of said conductor pipe, said plug having a core therein;

driving said conductor pipe into said sea bottom; and fracturing said core of said plug with the force used in driving said conductor pipe.

4. A method of installing a conductor pipe employed in sinking a well in a sea bottom, comprising:

providing a conductor pipe;

affixing a plug to the lower end of said conductor pipe;

penetrating said sea bottom with said plugged end of said conductor pipe; and drilling out said plug with the same drill bit employed in sinking the well associated with said conductor pipe.

5. A method of installing a tubular member in a sea bottom, comprising:

providing a tubular member;

affixing a plug to the lower end thereof, said plug having a fracturable core therein;

contacting said sea bottom with the plugged end of said tubular member; and fracturing said core of said plug by said contacting.

* * * * *